United States Patent [19]

Ott et al.

[11] Patent Number: 4,945,697

[45] Date of Patent: Aug. 7, 1990

[54] FLOOR TILE AND FLOOR

[75] Inventors: Willibald Ott; Günter Hoffmann, both of Wadern-Noswendel; Werner Jacobs, Losheim, all of Fed. Rep. of Germany

[73] Assignee: Saar-Gummiwerk GmbH, Wadern-Büschfeld, Fed. Rep. of Germany

[21] Appl. No.: 187,357

[22] Filed: Apr. 28, 1988

[51] Int. Cl.[5] ..... E04F 15/22

[52] U.S. Cl. ..... 52/396; 52/480; 404/31; 404/32

[58] Field of Search ..... 404/32, 31, 33, 28, 404/2; 52/301, 302, 303, 408, 480, 389, 396; 428/49; 272/3, 70

[56] References Cited

U.S. PATENT DOCUMENTS

| | | | |
|---|---|---|---|
| 3,041,785 | 7/1962 | MacDonald et al. | 52/389 X |
| 3,817,012 | 6/1974 | Wack et al. | 428/49 X |
| 3,902,293 | 9/1975 | Witt et al. | 272/3 X |
| 4,411,113 | 10/1983 | Zimmermann | 52/303 |
| 4,415,616 | 11/1983 | Angioletti | 52/389 X |
| 4,432,177 | 2/1984 | Amesso et al. | 52/389 X |
| 4,468,592 | 3/1987 | Harinishi | 52/480 X |
| 4,567,704 | 2/1986 | Bernett et al. | 52/389 X |
| 4,637,184 | 1/1987 | Radtke et al. | 52/408 X |

FOREIGN PATENT DOCUMENTS

| | | | |
|---|---|---|---|
| 0058825 | 9/1982 | European Pat. Off. | 272/3 |
| 0206329 | 12/1986 | European Pat. Off. | 272/3 |
| 3629798 | 3/1988 | Fed. Rep. of Germany | 272/3 |
| 220679 | 8/1924 | United Kingdom | 404/32 |

*Primary Examiner*—David A. Scherbel
*Assistant Examiner*—Lan Mai
*Attorney, Agent, or Firm*—Peter K. Kontler

[57] ABSTRACT

A floor or walkway has a base and an overlay on the base. The overlay includes a plurality of prefabricated tiles each of which has an upper layer designed to contact objects on the floor or walkway and a lower layer designed to bear against the base. The upper layers are composed of a ceramic while the lower layers are composed of a resilient material having anti-skid characteristics. The upper and lower layers of each tile are adhesively secured or vulcanized to one another during manufacture of the tile. The overlay is formed by simply placing the tile on the base or loosely securing the tiles to the base by means of an adhesive. If the overlay is outdoors, the same or gaps between neighboring tiles are kept open to permit water runoff. The lower layers of the tiles are then formed with drainage channels and/or open pores for the discharge of water which has passed through the seams or gaps. The opens seams or gaps in combination with the resilience of the lower layers allows the upper layers to shift vertically relative to one another so that the overlay can adapt to irregularities in the base. If the overlay is indoors where water is of no concern, the seams or gaps between neighboring tiles may be filled. The filling is flexible in order to permit relative vertical shifting of the upper layers of the tiles.

10 Claims, 2 Drawing Sheets

FLOOR TILE AND FLOOR

BACKGROUND OF THE INVENTION

The invention relates generally to a support such as a floor or walkway.

More particularly, the invention relates to an overlay for a support of this type.

A known overlay for a support such as a floor or walkway includes ceramic tiles and a layer of material interposed between the tiles and the base of the support. This intermediate layer functions to establish a connection between the tiles and the base and to compensate for the unevenness of the latter. The intermediate layer is frequently constituted by a bed of mortar.

On terraces and roofs, it is known to form an overlay on a base of concrete plates by laying tiles on the plates using mortar. It is further known to make a terrace on a roof by adhesively securing rubber mats of relatively low elasticity to the roof and then adhesively securing ceramic tiles to the mats. The seams between the tiles are subsequently filled with an elastic material.

It is also known to use loose rubber mats having drainage channels at their undersides as an intermediate layer beneath an overlay of gravel or loose concrete plates.

OBJECTS AND SUMMARY OF THE INVENTION

It is an object of the invention to provide an overlay for a support such as a floor or walkway which is relatively easy to apply.

Another object of the invention is to provide an overlay for a support such as a floor or walkway which can be applied relatively rapidly.

A further object of the invention is to provide a method which makes it possible to apply an overlay to a support such as a floor or walkway with relative ease and rapidity.

An additional object of the invention is to provide an overlay for a support such as a floor or walkway which contains ceramic tiles but can nevertheless be applied relatively easily and rapidly.

A concomitant object of the invention is to provide a tile for a support such as a floor or walkway which can be applied with relative ease.

It is also an object of the invention to provide a tile for a support such as a floor or walkway which is capable of being applied relatively rapidly.

Yet another object of the invention is to provide a tile for a support such as a floor or walkway which consists at least in part of ceramic but can nevertheless be applied relatively easily and rapidly.

Still a further object of the invention is to provide a method which allows a tile for a support such as a floor or walkway to be applied in a superior manner.

An additional object of the invention is to provide a support such as a floor or walkway having an overlay which can adapt to irregularities in a very satisfactory fashion.

The preceding objects, as well as others which will become apparent as the description proceeds, are achieved by the invention.

One aspect of the invention resides in a support such as a floor or walkway. The support comprises a base, and an overlay on the base including a plurality of prefabricated tiles each of which comprises a first or upper layer, preferably a ceramic-containing layer, designed to contact objects carried by the support and a resilient second or lower layer fast with the upper layer. The lower layers contact the base and have anti-skid characteristics, and the tiles are laid in such a manner that each of the upper layers is vertically shiftable relative to the other upper layers.

The tiles may simply be placed on the base so that they are only in frictional engagement with the same. Alternatively, the tiles may be loosely secured to the base, e.g., by means of an adhesive.

Another aspect of the invention resides in a prefabricated tile for a support such as a floor or walkway. The tile comprises a first layer which preferably contains a ceramic and is designed to contact objects carried by the support, and a second layer fast with the first layer and designed to bear against the support. The second layer is resilient and has anti-skid characteristics. In use, the first layer will normally constitute an upper layer of the tile while the second layer will normally constitute a lower layer.

The upper and lower layers of a tile may be vulcanized or adhesively secured to one another.

The relatively soft lower layers allow the tiles to be firmly held against movement on the base of the support even without an adhesive connection between the tiles and the base. The overlay is thus secure for walking. The security of the overlay can be enhanced by designing the surfaces of the tiles so as to also have anti-skid characteristics. The tiles further have adequate resistance to lifting by the wind inasmuch as the combined upper and lower layers are heavier and more compact than the upper layers alone. Any irregularities in the base of the support are compensated for by the elasticity or resilience of the lower layers. In contrast to a bed of mortar, such compensation has less of a permanent character and is more a temporary effect which occurs during loading. Moreover, the tiles do not break, even under point loading, e.g., by the leg of a table or chair, by a heel or the like. An important concept of the invention which contributes to the resistance of the tiles to breakage is the ability of the upper layers of the tiles to shift vertically relative to one another. This concentrates the supporting action for the tiles on the base, that is, inhibits introduction of the supporting forces from the edges of the tiles inwards and thereby limits the bending moments in the tiles.

The tiles can thus be relatively large as is desirable for easy and rapid laying thereof. Laying of the tiles can be carried out by simply placing the latter on the base after cutting to size if necessary. Such laying can even be performed by unskilled personnel. Furthermore, no water need be used for installation.

The tiles further have good heat insulation and sound damping characteristics. The sound damping characteristics make the overlay particularly well-suited for large halls. In addition, the elastic yieldability of the overlay makes the latter pleasant to walk on.

Another significant advantage of the tiles, particularly for the refurbishing of existing structures, is that their height may be small. The height of the tiles may, for example, be 3 to 4 cm as compared to at least 10 cm for a conventional overlay, e.g., an overlay for elevated (wash) concrete plates.

The tiles also make it possible to easily and rapidly construct a walkway, for instance, on a flat roof. The tiles may here be spaced from one another by a distance corresponding to the stride of a person.

When the overlay is indoors, it may be desirable to seal or fill the seams between neighboring tiles and, in such an event, the resulting joints must be flexible. In this regard, it is possible to press soft hollow shapes into the seams and to connect these shapes with the edges of the upper layers of the tiles by means of an adhesive. For an indoor overlay, the lower layers of the tiles may be made of a somewhat harder material and, depending on the circumstances, without recesses so that the upper layers are depressed less under load. Thus, the base of an indoor support will generally be more uniform, or can be made uniform more easily, than the base of an outdoor support thereby requiring less adaptation of the tiles to the base.

The materials selected for indoor and outdoor tiles may differ for another reason also. In order to prevent odors, the lower layers of tiles intended for indoor use cannot be made from waste products. On the other hand, such products, which reduce production costs, are acceptable for outdoor use.

The overlay according to the invention is particularly well-suited for the outdoors inasmuch as the seams should here always be kept open. This not only saves the expense of filling the seams but also allows the upper layers of the tiles to shift vertically relative to one another with absolute freedom and no restraint. Water can pass through the seams and flow off through or beneath the tiles. The lower layers of tiles for outdoor use are accordingly designed for drainage.

The undersides of the lower layers, that is, the sides of the lower layers adjacent to the base, may be formed with recesses or channels into which water can flow. Advantageously, the undersides of the lower layers are provided with projections so that the tiles bear against the base only with the projections which define large recesses or channels extending in various directions.

The lower layers of the tiles may be composed of a material having open pores. A currently preferred material of this type is granulated rubber. Depending upon the particular application and the degree of porosity, the pores may be capable of providing adequate drainage. The porosity may also be used to adjust the elasticity of the material constituting the lower layers.

Aside from the function of drawing off water, the channels and/or pores formed in the lower layers may serve to ventilate the backs of the tiles. Channels and/or pores for ventilation purposes may likewise be provided in the lower layers of tiles intended for indoor use.

As already indicated, adequate frictional engagement between the tiles and the base is obtained, as a rule, by simply placing the tiles on the base. There is, however, no harm in establishing a loose adhesive connection between the tiles and the base. Where circumstances are such that the frictional engagement is insufficient, a thin layer of adhesive may be applied between the tiles and the base, e.g., at spaced locations of the overlay. The adhesive connection for an indoor overlay may be different from that for an outdoor overlay. Thus, the tiles of an outdoor overlay are to be removed at predetermined intervals, e.g., every 10 to 15 years, in order to maintain the water drainage channels by removing dirt accumulations, plant growths and so on. Accordingly, the adhesive connection for an outdoor overlay should always be such as to allow the tiles to be pulled from the base.

In an outdoor overlay, a gap, which extends over the height of the lower layers, exists between neighboring tiles so that water may easily and rapidly flow downwards through the overlay into the drainage channels and/or pores. On the other hand, assuming that this does not significantly affect a desired ventilation of the backs of the tiles, the lower layers of the tiles for an indoor overlay may extend laterally beyond the edges of the upper layers by a distance equal to one-half of the gap to be established between the upper layers of neighboring tiles. The tiles are then laid with the edges of the lower layers of neighboring tiles in abutment. This allows uniform gaps to be automatically established between the upper layers of neighboring tiles during laying of the latter and insures that such gaps are maintained over time.

Uniform gaps may also be readily achieved by placing suitable moldings which serve as spacers between neighboring tiles.

To make the tiles, the lower layers may be punched or stamped from a blank and secured to the upper layers by means of an adhesive. Advantageously, however, the tiles are manufactured using vulcanizing molds to produce the lower layers which are then vulcanized to the upper layers during the production process for the lower layers.

A fiberglass net may be disposed between the upper and lower layer of each tile to increase the bending resistance of the tile.

The lower layers may be made from granulated rubber which, for outdoor use, may be largely constituted by scrap material or waste material as indicated earlier. Solid rubber may also be used but will find less application. Rubber has the advantages that it does not soak up water and adheres well to the base of the support. Nevertheless, elastic or resilient materials other than rubber may be employed for the lower layers of the tiles. For example, the lower layers may be composed of a polyurethane foam or of granulated rubber bound with polyurethane.

The novel features which are considered as characteristic of the invention are set forth in particular in the appended claims. The improved overlay and tile themselves, however, both as to their construction and the mode of using the same, will be best understood upon perusal of the following detailed description of certain specific embodiments when read in conjunction with the accompanying drawings.

DESCRIPTION OF THE PREFERRED EMBODIMENTS

Figure 1:
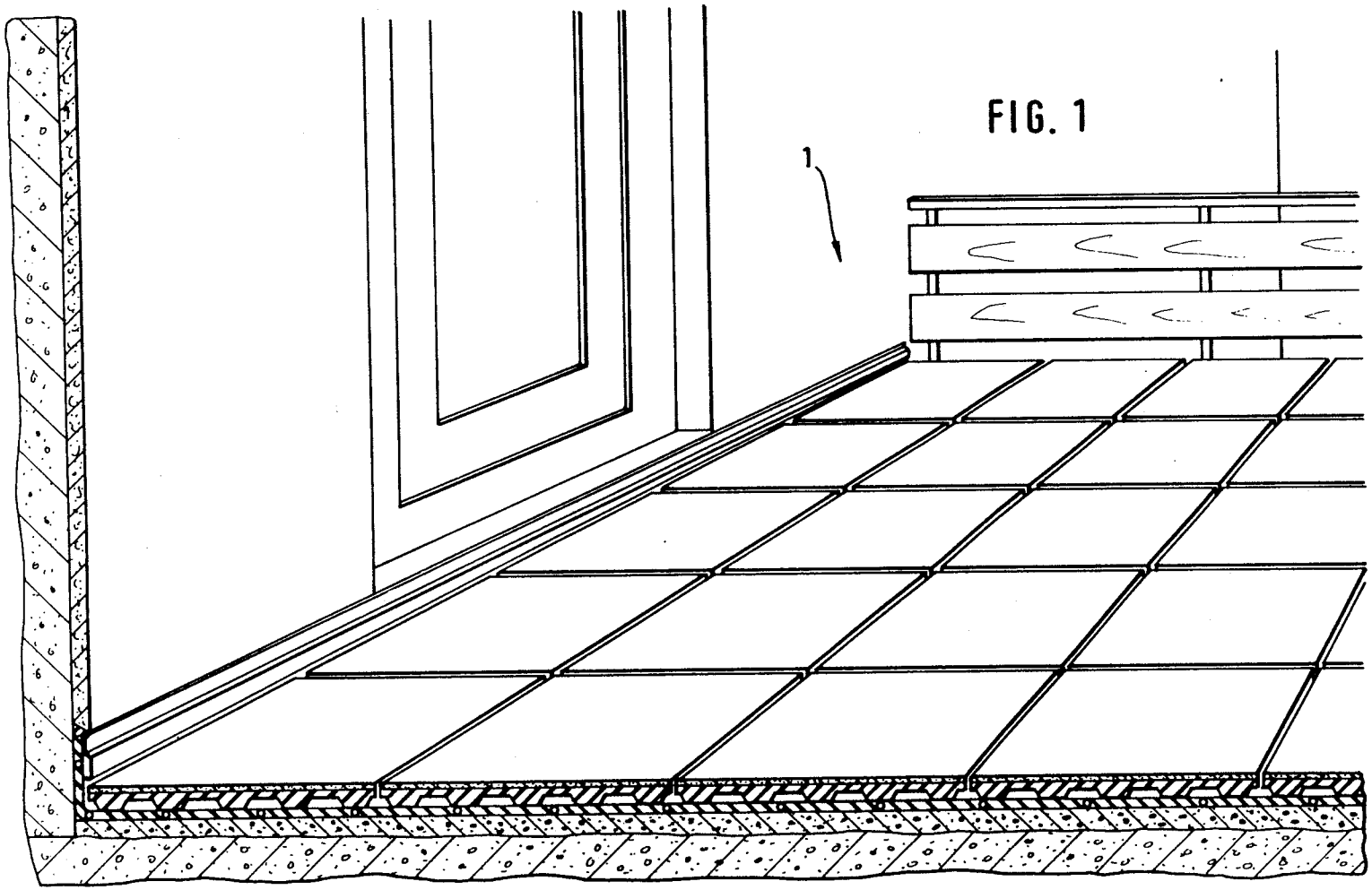
FIG. 1 is a partly vertical sectional view and partly perspective view of a terrace having an overlay in accordance with the invention.
Figure 2:
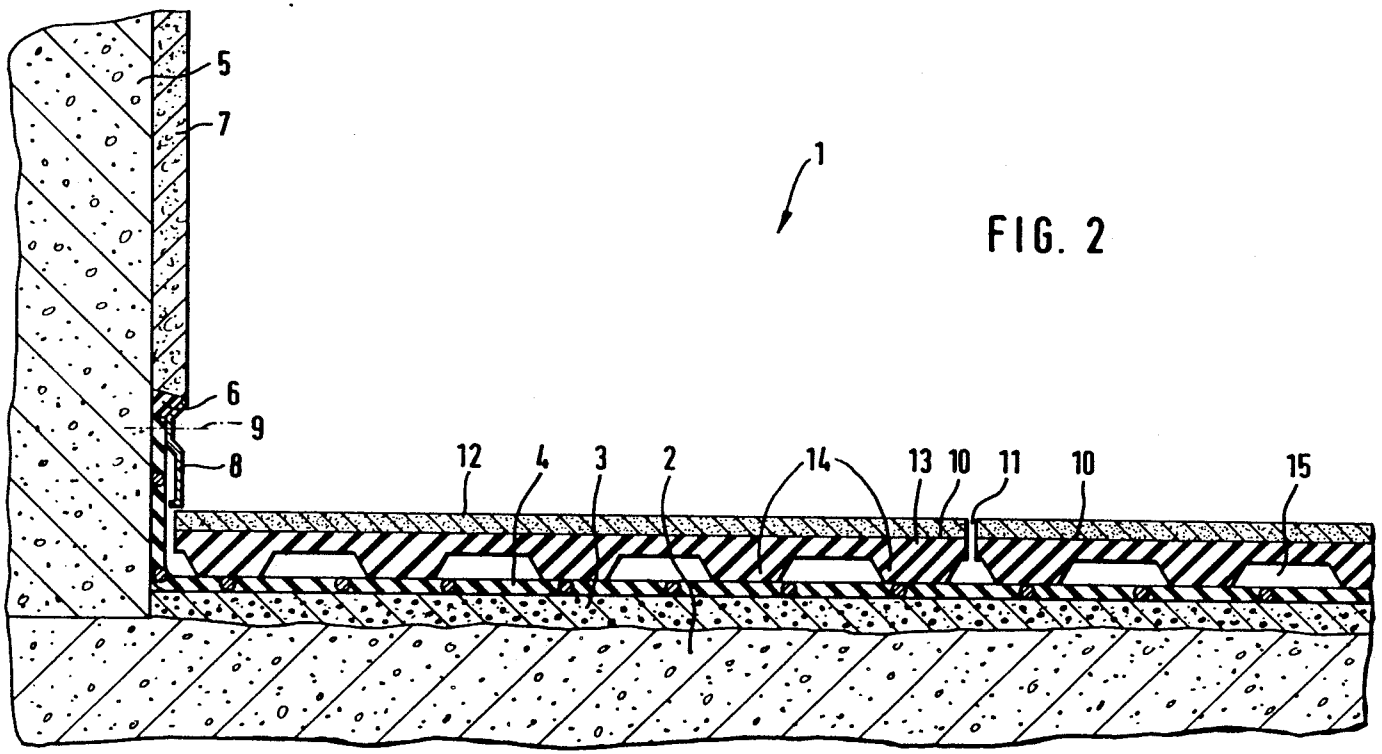
FIG. 2 is an enlarged vertical sectional view of the terrace of FIG. 1.

Referring to FIGS. 1 and 2, the reference numeral 1 generally identifies a terrace. The terrace 1 is situated at an elevated level of a building and is disposed on the ceiling 2 of a room located on a story of the building immediately below that with the terrace 1. Accordingly, the terrace 1 must function as a roof, that is, must be impervious to water.

The ceiling 2, which is composed of plain or raw concrete, is covered by a layer 3 of material constituting a leveling mass. A continuous or unbroken rubber mat 4 extending across the entire surface of the terrace 1 overlies the leveling layer 3. The rubber mat 4 has an edge which borders a wall 5 of the building and this edge is bent upwards so that it parallels and lies adjacent to the wall 5.

The wall 5 is provided with a coating 7 of plaster having a lower end which is spaced from the upper surface of the rubber mat 4. A shaped wall joint member 8 extends downwards from the lower end of the plaster coating 7 and the junction between the coating 7 and the member 8 is sealed by a seal 6. The member 8 is spaced from the wall 5 to define a downwardly open chamber and the raised edge of the rubber mat 4 projects into this chamber. The reference numeral 9 identifies fastening means extending through the member 8 and into the wall 5.

The bottom of the terrace 1 constitutes a support resembling a floor and the ceiling 2, leveling layer 3 and rubber mat 4 may together be considered to form a base of the support. The base 2-4 is provided with an overlay made up of prefabricated tiles 10 which rest on the rubber mat 4. The tiles 10 are arranged so that neighboring ones of the tiles 10 define seams or gaps 11. The overlay is here assumed to have been formed by simply placing the tiles 10 on the mat 4, that is, the tiles 10 are here assumed to be only in frictional engagement with the base 2-4. However, it is also possible for the tiles 10 to be loosely secured to the base 2-4, e.g., by means of an adhesive. If the tiles 10 are secured to the base 2-4, the connection should be such that the tiles 10 may be pulled from the base 2-4 with relative ease.

Each of the tiles 10 comprises a first or upper ceramic layer 12 and a second or lower layer 13 which is secured to the upper layer 12. As already mentioned, the tiles 10 are prefabricated and the lower layer 13 of a tile 10 is secured to the upper layer 12 during manufacture of the tile 10. The upper layer 12 and lower layer 13 of a tile 10 may be adhesively connected or vulcanized to one another.

The upper layers 12 are designed to be in direct contact with objects on the terrace 1 including shoes, tables and chairs. On the other hand, the lower layers 13 are designed to be in direct contact with the base 2-4 of the terrace 1.

The lower layers 13 of the tiles 10 are resilient and have anti-skid characteristics. In this regard, it is preferred for the lower layers 13 to be composed of granulated rubber. However, other elastic or resilient materials such as, for instance, solid rubber, polyurethane foam and granulated rubber bound with polyurethane, may also be used.

The seams or gaps 11 between neighboring tiles 10 are open or exposed and this feature, in combination with the resilient nature of the lower layers 13, allows the upper layer 12 of any tile 10 to shift vertically relative to the upper layer 12 of any other tile 10. This makes it possible for the overlay of tiles 10 to compensate for or adapt to irregularities in the upper surface of the base 2-4. The anti-skid characteristics of the lower layers 13 enable the tiles 10 to remain in position on the base 2-4 in spite of the fact that the tiles 10 are not, or are only loosely, secured to the base 2-4.

The terrace 1 is located outdoors and is thus exposed to the elements. In order to prevent undue accumulation of water on the overlay of tiles 10, the seams 11 are open or exposed as outlined earlier. This allows water to run off from the overlay of tiles 10 towards the rubber mat 4. To permit discharge of the water from the terrace 1, the lower layers 13 of the tiles 10 are designed for drainage. Thus, the undersides of the lower layers 13 are provided with conical or pyramidal projections 14 which cooperate to define recesses or channels 15 extending in various directions. The tiles 10 bear against the base 2-4 by way of the projections 14 which extend from the lower layers 13 in a direction away from the upper layers 12. The channels 15, which open to the rubber mat 4, constitute drainage channels for water which runs off from the upper surface of the overlay of tiles 10. Rainwater, cleaning water and so on passes through the seams 11 between neighboring tiles 10 and flows off on the rubber mat 4 via the drainage channels 15.

The lower layers 13 may be formed with open pores for drainage purposes. These pores may be provided in lieu of or in addition to the drainage channels 15.

If the overlay of tiles 10 is located indoors where water accumulation does not present a problem, the seams 11 may be filled. The filling used should, however, be flexible in order to permit vertical shifting of the upper layers 12 relative to one another.

The upper layers 12 may be square and each such layer advantageously has a relatively large area, e.g., dimensions of 40×40 cm. Preferably, the dimensions of the upper layers 12 lie between 30×30 cm and 50×50 cm.

The thickness of the upper layers 12 may, for example, lie in the range of 9 to 12 mm and is advantageously 10 to 11 mm. In the regions between the projections 14, the thickness of the lower layers 13 is, for instance, 8 to 20 mm with a thickness of 8 to 12 mm being preferred.

By way of example, the upper ends of the projections 14 may have a diameter of 30 to 60 mm while the lower ends have a diameter of 20 to 50 mm. Advantageously, however, the diameter of the upper ends is in the range of 40 to 50 mm and the diameter of the lower ends in the range of 30 to 40 mm.

The shortest distance between neighboring projections 14 as measured in a direction parallel to the edge of a tile 10 may, for instance, equal the upper diameter of the projections 14. However, this distance may vary from 0.75 to 1.25 times the upper diameter.

Without further analysis, the foregoing will so fully reveal the gist of the present invention that others can, by applying current knowledge, readily adapt it for various applications without omitting features that, from the standpoint of prior art fairly constitute essential characteristics of the generic and specific aspects of our contribution to the art and, therefore, such adaptations should and are intended to be comprehended within the meaning and range of equivalence of the appended claims

We claim:

1. A support such as a floor or walkway, comprising a base; and an overlay on said base including a plurality of prefabricated tiles each of which comprises a first layer designed to contact objects carried by said support and a resilient second layer fast with the respective first layer, said second layers contacting said base and having anti-skid characteristics producing a relatively high coefficient of friction between said base and each of said second layers, and said tiles being arranged such that, upon loading of one of said tiles so as to compress the respective second layer, the first layer of said one tile is vertically shiftable relative to the first layer of an unloaded tile, said tiles being only in frictional engagement with said base.

2. A support such as a floor or walkway, comprising a base; and an overlay on said base including a plurality of prefabricated tiles each of which comprises a first layer designed to contact objects carried by said support and a resilient second layer fast with the respective first layer, said second layers contacting said base and having anti-skid characteristics producing a relatively high coefficient of friction between said base and each of said second layers, and said tiles being arranged such that, upon loading of one of said tiles so as to compress the respective second layer, the first layer of said one tile is vertically shiftable relative to the first layer of an unloaded tile, said second layers being designed for drainage, and neighboring ones of said tiles defining seams, said seams being open.

3. A support such as a floor or walkway, comprising a base; and an overlay on said base including a plurality of prefabricated tiles each of which comprises a first layer designed to contact objects carried by said support and a resilient second layer fast with the respective first layer, said second layers contacting said base and having anti-skid characteristics producing a relatively high coefficient of friction between said base and each of said second layers, and said tiles being arranged such that, upon loading of one of said tiles so as to compress the respective second layer, the first layer of said one tile is vertically shiftable relative to the first layer of an unloaded tile, said second layers having open pores.

4. A support such as a floor or walkway, comprising a base; and an overlay on said base including a plurality of prefabricated tiles each of which comprises a first layer designed to contact objects carried by said support and a resilient second layer fast with the respective first layer, said second layers contacting said base and having anti-skid characteristics producing a relatively high coefficient of friction between said base and each of said second layers, and said tiles being arranged such that, upon loading of one of said tiles so as to compress the respective second layer, the first layer of said one tile is vertically shiftable relative to the first layer of an unloaded tile, said second layers comprising granulated rubber.

5. A support such as a floor or walkway, comprising a base; and an overlay on said base including a plurality of prefabricated tiles each of which comprises a first layer designed to contact objects carried by said support and a resilient second layer fast with the respective first layer, said second layers contacting said base and having anti-skid characteristics producing a relatively high coefficient of friction between said base and each of said second layers, and said tiles being arranged such that, upon loading of one of said tiles so as to compress the respective second layer, the first layer of said one tile is vertically shiftable relative to the first layer of an unloaded tile, said second layers being provided with recesses adjacent to said base.

6. The support of claim 5, wherein said second layers have projections which contact said base and define said recesses.

7. A prefabricated tile for a support such as a floor or walkway, comprising a first layer designed to contact objects carried by the support; and a second layer fast with said first layer and designed to carry the same, said second layer being resilient and having anti-skid characteristics enabling a relatively high coefficient of friction to be produced between said second layer and a supporting surface in contact therewith, and said second layer having open pores.

8. A prefabricated tile for a support such as a floor or walkway, comprising a first layer designed to contact objects carried by the support; and a second layer fast with said first layer and designed to carry the same, said second layer being resilient and having anti-skid characteristics enabling a relatively high coefficient of friction to be produced between said second layer and a supporting surface in contact therewith, and said second layer comprising granulated rubber.

9. A prefabricated tile for a support such as a floor or walkway, comprising a first layer designed to contact objects carried by the support; and a second layer fast with said first layer and designed to carry the same, said second layer being resilient and having anti-skid characteristics enabling a relatively high coefficient of friction to be produced between said second layer and a supporting surface in contact therewith, and said second layer being provided with open recesses.

10. The tile of claim 9, wherein said second layer has projections extending away from said first layer and defining said recesses.

* * * * *